US007933429B2

(12) United States Patent
Lutz

(10) Patent No.: US 7,933,429 B2
(45) Date of Patent: Apr. 26, 2011

(54) VIBRATING ELEMENT FOR AN ELECTROACOUSTIC TRANSDUCER

(75) Inventor: Josef Lutz, Vienna (AT)

(73) Assignee: NXP B.V., Eindhoven (NL)

( * ) Notice: Subject to any disclaimer, the term of this patent is extended or adjusted under 35 U.S.C. 154(b) by 1037 days.

(21) Appl. No.: 11/575,933

(22) PCT Filed: Sep. 20, 2005

(86) PCT No.: PCT/IB2005/053086

§ 371 (c)(1),
(2), (4) Date: Mar. 23, 2007

(87) PCT Pub. No.: WO2006/033075

PCT Pub. Date: Mar. 30, 2006

(65) Prior Publication Data

US 2008/0205689 A1 Aug. 28, 2008

(30) Foreign Application Priority Data

Sep. 23, 2004 (EP) ..... 04104626

(51) Int. Cl.
*H04R 25/00* (2006.01)

(52) U.S. Cl. ..... 381/409; 381/398; 381/410

(58) Field of Classification Search ..... 381/398, 381/403, 404, 407, 409, 410, 423, 424, 430, 381/400; 29/594, 609.1
See application file for complete search history.

(56) References Cited

U.S. PATENT DOCUMENTS

| | | | | |
|---|---|---|---|---|
| 2,392,143 | A * | 1/1946 | Graham | 381/398 |
| 5,850,462 | A * | 12/1998 | Sakamoto et al. | 381/405 |
| 7,672,473 | B2 * | 3/2010 | Horigome et al. | 381/433 |

FOREIGN PATENT DOCUMENTS

| | | | |
|---|---|---|---|
| EP | 0720415 | A | 7/1996 |
| JP | 06086385 | A | 6/1994 |
| JP | 07038993 | A | 6/1995 |

* cited by examiner

*Primary Examiner* — Huyen D Le

(57) ABSTRACT

A vibrating element (1) for an electroacoustic transducer, particularly for a loudspeaker, is provided, comprising a diaphragm (2) with at least two electrically conductive areas (3*a*, 3*b*) separated from each other, and with a recess (4). In the recess (4) a coil (5) is arranged with two connecting leads (6*a*, 6*b*), which are electrically contacted with one conductive area each (3*a*, 3*b*). The contact points (8*a* . . . 8*d*) are then located in the area of the recess (4). Furthermore, a method for the manufacturing of a vibrating element (1) is provided. The recess (4), the inserting of the coil (5) into the recess (4) as well as optionally the contacting of connecting leads (6*a*, 6*b*) with the conductive areas (3*a*, 3*b*) can then take place in one process step.

13 Claims, 5 Drawing Sheets

VIBRATING ELEMENT FOR AN ELECTROACOUSTIC TRANSDUCER

FIELD OF THE INVENTION

The invention relates to a vibrating element for an electroacoustic transducer, comprising: a diaphragm with a recess and at least two electrically conductive areas, which are separated from each other, and a coil arranged in the recess and having two connecting leads which are electrically contacted with one conductive area each.

Furthermore, the invention relates to a loudspeaker with said vibrating element as well as to a method for the production of the vibrating element.

BACKGROUND OF THE INVENTION

Vibrating elements of said type are to be found particularly in loudspeakers of relatively small size, which are needed in large numbers for diverse electronic devices. With loudspeakers of this order of magnitude, plastic foils are predominantly used for the production of their diaphragms, wherein materials such as polycarbonate, polyarylate, polypropylene, polyethylennaphtalate, polyimide or even polyetherimide are used in material thicknesses of approximately 8 μm to 150 μm. Here it is pointed out that the list of usable plastics is not by any means complete and therefore the use of other materials is also imaginable. Frequently, a high-pressure deep-drawing method is applied herein, with which a plastic foil is heated up to the glass transition temperature of about 220° C. and is then pressed on a mold with a pressure of 20 bar to 25 bar. But, in principle, other drawing and stamping methods are also possible for the production of a diaphragm, particularly also those with a mold and a countermold.

Partly, so-called "bag diaphragms" are used, with which a recess is produced during the pressing process for the incorporation of a moving coil. The insertion of the coil takes place in such a way that the connecting leads lie on the upper side of the coil and are thus yet easily accessible even after the insertion. In quite a number of cases these connecting leads are led to the edge of the diaphragm and connected there to a housing of a loudspeaker, in which the vibrating element is used. This lead, which is, on the one hand, connected to the fixed housing, but, on the other hand, also to the moved vibrating element, leads to a number of problems besides having the advantage of a small electrical resistance:

The life span of the wire loop and its connections to fixed and moved parts is very limited, particularly with high amplitudes of the diaphragm.

The acoustic behavior of the vibrating element is considerably influenced by the wire loop. Apart from the fact that the diaphragm cannot completely swing freely due to the stiffness of the wire and the limiting frequency is thus very limited, each deviation of the wire loop from a predefined form leads to an influencing of a predefined vibrating and frequency behavior.

It should be taken care that the connecting lead does not touch the vibrating element or the loudspeaker housing at another place than the one provided for it, as this can lead to undesirable noise.

the wire loop even has an undesired self-resonant frequency.

the production process is comparatively complex, as the partly very thin wires must be led in a predefined way.

For this reason, diaphragms have already been used for some time, which diaphragms have electrically conductive areas in the form of a coating of an electrically conductive material. In addition, the coil wire is contacted with a conductive area in direct proximity of the coil and the connection to external connecting leads is accomplished by means of these conductive areas. This indeed reduces the problems mentioned above, but does not eliminate them completely. Moreover, the diaphragm at the contact points is stiffened by the necessary adhesive or solder joint, which again changes its acoustic characteristics. A further problem is the degradation of a conductive adhesive, which leads to strong resistance changes in the course of time.

Therefore, it is an object of the invention to provide a vibrating element with which said problems are avoided.

OBJECT AND SUMMARY OF THE INVENTION

The object of the invention is achieved with a vibrating element of the type set forth in the opening paragraph, in which the contact points are arranged in the area of the recess. In this way, said wire loop, which causes the problems mentioned above, can be avoided. As the contact points lie in the area of the recess in which the coil is incorporated, these move along with the coil. For this reason there is no relative motion between the coil and the ends of the connecting leads, which relative motion would reduce the lifespan of the connecting leads or the contact points. Furthermore, the diaphragm is not stiffened either with a solder or adhesive joint in an undesirable area. Finally, the production process is simplified, as no connecting leads have to be led in a predefined way. At this point it is noted that the coil does not mandatorily comprise only two connecting leads. Additional windings for compensation or measuring purposes are also possible.

It is advantageous if both contact points are arranged on the inside of the recess. In this case the connecting leads of the coil lie on the underside of the coil or on its side faces and are automatically contacted with the conductive areas when the coil is inserted into the recess. Then the coil wires can lie against the coil or can be glued to this coil respectively. In this case, no connecting leads stand away from the coil, as a result of which the coil can be handled more easily. It should only be seen to it that an insulation of the coil wire at the contact point is removed.

It is also advantageous if both connecting leads penetrate the diaphragm in the lower area of the recess and both contact points are on the outside of the recess. It may perhaps be more advantageous to coat the diaphragm on its underside, based on construction details. In this case, the connecting leads penetrate the diaphragm, either through a prefabricated hole or also directly when the coil is inserted into the recess. In the latter case, a heating up of the diaphragm and/or the connecting leads may be advantageous, as the diaphragm, which usually comprises a thermoplastic, can then be pierced more easily. When the coil is inserted, the connecting leads may also be bent at the underside of the diaphragm in order to facilitate the contacting. Furthermore, the bending of the connecting leads contributes to the coil being held in the recess.

Finally, it is also advantageous if a contact point is arranged on the inside of the recess and a connecting lead penetrates the diaphragm in the lower area of the recess and the associated contact point is on the outside of the recess. Here, a diaphragm completely coated on both sides may be used advantageously, which diaphragm is relatively simple to produce. One contact area is then located on the upper side of the diaphragm, another one on the underside.

It is particularly advantageous if the conductive areas are formed such that the connecting leads are electrically contacted with the conductive areas largely independently of the mounting position of the coil. When a coil is inserted into a recess of the diaphragm, again and again angular misalignment of the coil occurs. In order that the contacting between conductive areas and the connecting leads does not take place or takes place only faultily because of this, the conductive areas are arranged such that they cover a circular arc. Twisting the coil when the vibrating element is manufactured can thus be compensated advantageously in this way.

An advantageous vibrating element is one in which the electrically conductive areas comprise an electrically conductive coating applied on the diaphragm. As materials for the conductive coating, essentially all conductive metals can be used, particularly precious metals, which are applied, for example, by sputtering, physical vapor deposition, chemical vapor deposition or similar methods. But, the use of glued foils of metal, particularly of aluminum or copper, is also possible. Corresponding shapes of the conductive areas may—insofar as this is necessary—be produced, for example, by subsequent etching. Besides metallic coatings, it is also possible that the diaphragm comprises a semiconductor material and that the conductive areas are produced by corresponding doping. In this context plastics are also mentioned, which can be made electrically conductive by corresponding doping.

It is advantageous, if the coil is fastened in the recess by means of an adhesive, as friction and form fit between coil and diaphragm or the coated areas respectively are often not sufficient in the long term to hold the coil in the recess. A cheap, electrically non-conductive standard adhesive may then be used.

Furthermore, a vibrating element is advantageous, with which contacting between connecting leads and electrically conductive areas is realized by soldering, by welding or by means of an electrically conductive adhesive. If the contacting force between connecting leads and conductive areas is not sufficient to achieve sufficiently small transition impedance, contacting can also take place by means of soldering, welding or gluing. This reduces the transition impedance as against the mere body contact, and increases the lifespan of the contacting.

When soldering, a solder must reach the contact points. This can be effected in such a way that either the connecting leads or the conductive areas or both are provided with solder balls in the corresponding places before the molding operation, which balls melt when or after inserting the coil into the recess and thus provide the contacting between connecting leads and conductive areas.

The use of a low melting solder is also advantageous, because the temperature prevalent with the deformation operation of the diaphragm may not be sufficient to make a standard solder melt. But from the state of the art, some solders are known, which already melt partly below 100° C. In this context U.S. Pat. No. 6,740,544 "Solder compositions for attaching a die to a substrate", dated 25 May 2004 is referred to, particularly to the table 1 in column 6 of the document. Furthermore, the document also reveals a possibility of raising the melting point of the solder again with what are called "solder agents" when soldering. This method is of advantage, particularly, when the electroacoustic transducers are to be operated in an environment with a raised temperature.

When welding, the supply of an additive can be dispensed with, due to which the contacting is simpler to produce in this way. As the temperatures for deformation of the diaphragm would be, in general, below the melting temperature of the metals used with connecting leads and conductive areas, the parts are connected by, what is called cold-press welding, but the use of the ultrasonic welding method is also possible.

Cold-press welded joints take place under high pressure and below the recrystallisation temperature of the individual parts. Herein, the partners remain in the solid state, but a plastic deformation bringing the contact areas much closer together is necessary. The extreme touching of the two contact areas provides a stable connection of the two workpieces due to intermediate atomic binding force. In order to obtain a good connection, minimum deformations of materials with sufficient cold ductility are necessary, for example, copper and aluminum together. Supplied heat then facilitates the welding process.

Finally, contacting may also take place by means of an electrically conductive adhesive, which is attached like the solder when the connecting leads or the contact points are soldered. Advantageously, the contact point is then arranged in such a way that it is cut off from the outside air after the coil has been inserted into the recess. With the lacking or smaller portion of oxygen opposite an open splice the already addressed degradation takes place considerably slower or can even be prevented. The resistance value of the splice, therefore, does not change or does so only barely.

An object of the invention is also achieved with an electroacoustic transducer, thus particularly a loudspeaker or a microphone, which comprises a vibrating element in accordance with the invention. It is then advantageous, if the conductive areas of the diaphragm are formed in such a way that two external connecting leads, which are arranged at a specific position of the transducer contact one electrically conductive area each to a large extent independently of the mounting position of the vibrating element. When inserting a vibrating element into the housing of a loudspeaker, again and again angular misalignment of the vibrating element occurs. To avoid contacting or faulty contacting between conductive areas and the external connecting leads therefore as a result of this, the conductive areas are arranged in such a way that they cover a circular arc at the external contact point. Twisting the vibrating element when an electroacoustic transducer is manufactured can advantageously be compensated in this way.

Finally, an object in accordance with the invention is also achieved with a method for producing a vibrating element for an electroacoustic transducer, in which a diaphragm of the vibrating element first has at least two electrically conductive areas, separated from each other, which method comprises the steps of:

producing a recess in the diaphragm, and inserting a coil which comprises two connecting leads, into the recess, so that the connecting leads are electrically contacted with one conductive area each, and the contact points are located in the area of the recess.

It is noted that said advantages and embodiments for the vibrating element in accordance with the invention, which advantages and embodiments result from specific production steps, also apply to the method in accordance with the invention and vice versa. A separate argumentation with respect to the realization of a specific characteristic is therefore done without, which was already mentioned with the vibrating element in accordance with the invention.

Anyway, a method is advantageous, with which the coil is taken up in a mold for the manufacture of the diaphragm and/or constitutes a part of the mold, with which mold the recess is produced, and the providing of the recess as well as the inserting of the coil into the recess takes place in one process step. The coil, which still remains in the recess after the molding operation, therefore need not be inserted in a separate process step. The manufacture of a vibrating element in accordance with the invention is therefore particularly simple.

It is then particularly advantageous if also the contacting between conductive areas and connecting leads takes place in the same process step. It is then particularly simple, for example, if the contacting takes place merely by body contact, because this contact takes place automatically when the coil is inserted into the recess when recess, coil and connecting leads are suitably modeled. But soldering, welding or adhesion processes can take place simultaneously with the insertion of the coil into the recess.

It is then particularly advantageous, if pressure and/or heat are supplied during manufacturing, whereby simultaneously both the deforming process and the contacting process are supported or enabled. As a rule, pressure, heat or both will be necessary for the deformation of the diaphragm. At the same time, this heat and/or pressure can be utilized, for example, for welding or soldering, as a result of which there is a synergetic use of supplied energy. When soldering, a solder is then advantageously selected whose melting point is in fact below the temperature prevailing during the modeling, but above the later operating temperature of the vibrating element. The solder agents already mentioned may help, if the operating temperature is too close to the deformation temperature or even below it.

These and other aspects of the invention are apparent from and will be elucidated with reference to the embodiments described hereinafter, though the invention should not be considered to be limited to these.

BRIEF DESCRIPTION OF THE DRAWINGS

Figure 1A:
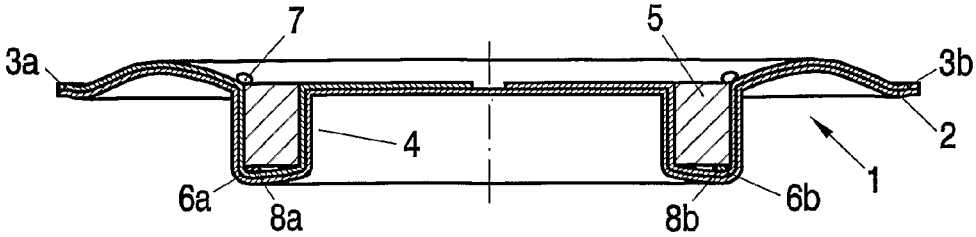
FIG. 1*a*: shows a vibrating element in section.

FIG. 1*a* shows in section a vibrating element 1 in accordance with the invention, which vibrating element 1 comprises a diaphragm 2 and a coil 5. The diaphragm 2 has at its upper side two electrically conductive areas 3*a*, 3*b* separated from each other in the form of an electrically conductive coating applied on the diaphragm 2. Furthermore, the diaphragm 2 has a recess 4, in which the coil 5 is incorporated. At the under side of the coil 5 two connecting leads 6*a*, 6*b* of the coil 5 are arranged. At the two contact points 8*a*, 8*b* said connecting leads 6*a*, 6*b* are electrically contacted with the conductive areas 3*a*, 3*b*. As can be inferred well from the FIG. 1*a*, the contact points 8*a*, 8*b* are in the lower area of the recess 4 on its inside. Finally, the coil 5 is secured against falling out by means of adhesive 7.

Figure 1B:
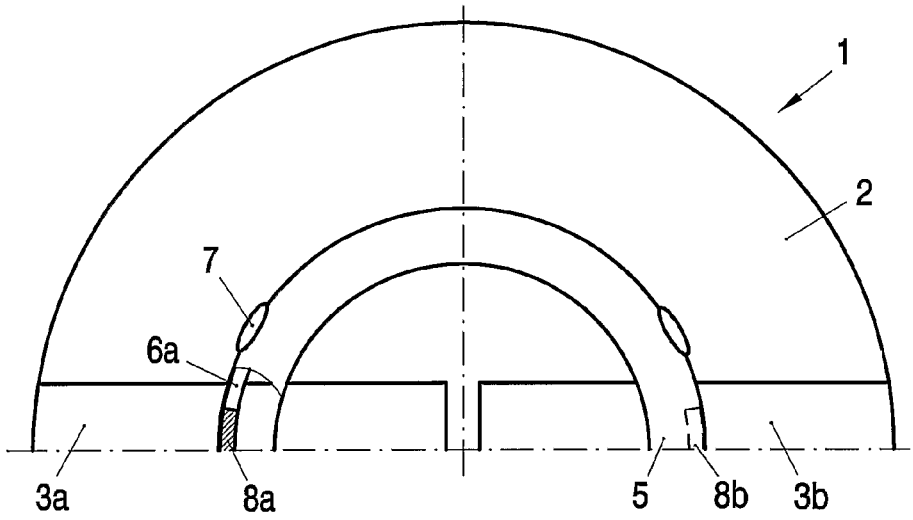
FIG. 1*b*: shows the vibrating element of FIG. 1*a* in top view.

The FIG. 1*b* shows the vibrating element 1 from FIG. 1*a* now in top view. It is well visible that the electrically conductive areas 3*a*, 3*b* are present in the form of a strip arranged on the upper side of the diaphragm 2 and interrupted in the center. This form of coating can be established comparatively simply by applying two metallic strips. FIG. 1*b* shows a material-saving form of the coating. However, it is also possible that nearly the entire surface of the diaphragm 2 is coated. The contact points 8*a*, 8*b* are now arranged, as can be seen from the FIG. 1*b*, approximately at the intersection of the outside edge of the coil 5 with the conductive areas 3*a*, 3*b*. In the present example the coil 5 is additionally secured against falling out by three oblong points of adhesive 7. Naturally, any other number of points, or also a continuous adhesive bead, is possible. It goes without saying that the coil 5 can additionally or also exclusively be glued to the inner circle of the coil 5.

Figure 2A:
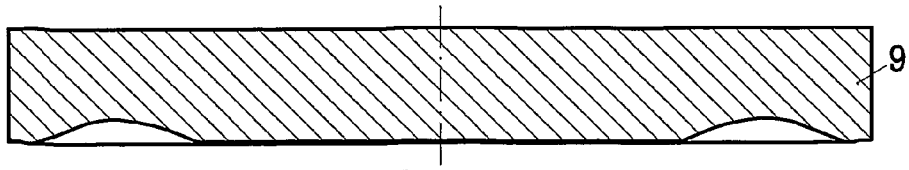
FIGS. 2*a*-2*e*: show the steps for the production of a vibrating element of FIGS. 1*a*, 1*b*, in accordance with a first production process.
Figure 2B:
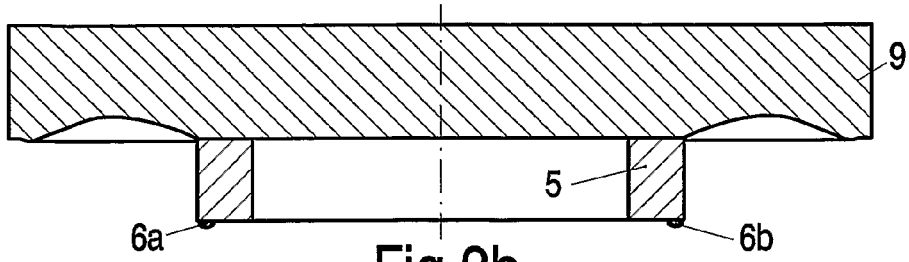
Figure 2C:
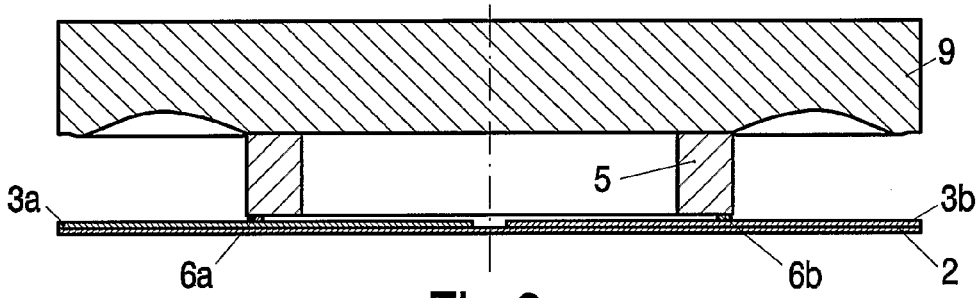

The FIGS. 2*a*-2*e* now show the steps of the production of a vibrating element from FIGS. 1*a*, 1*b* in accordance with a first production process. FIG. 2*a* shows the empty mold 9 for the production of the vibrating element 1. In a first step 2*b* the coil 5 is now inserted into the mold 9 in such a way that the connecting leads 6*a*, 6*b* are arranged on the side turned away from mold 9. For the sake of simplicity the mold 9 is shown completely flat represented in the holding area of the coil. For easier fixing of the coil 5 in the mold, also a flange may be provided of course.

In a second step 2*c* now the diaphragm 2, which already comprises conductive areas 3*a*, 3*b* in the form of a metallic coating, is led to the mold 9. The diaphragm 2, which in the present example comprises a thermoplast, is then heated beforehand, so that the subsequent formation can take place more easily. The vibrating element 2 is now formed in a third step 2*d*. Increased air pressure is then applied on the side of the diaphragm 2 turned away from the mold 9, so that the diaphragm 2 is pressed against the mold 9. In practice, additional fixings and seals are naturally necessary herein, which are, however, not shown in the Figures for the sake of simplicity. Another possibility would be to press a corresponding countermold against the diaphragm 2.

Figure 2D:
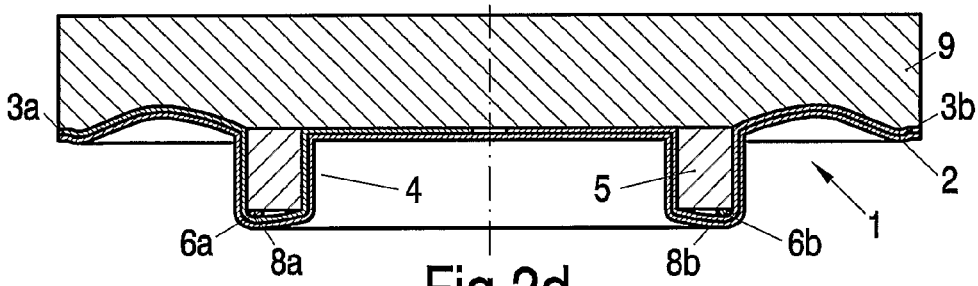

It is easy to recognize in FIG. 2*d* that the coil 5 constitutes a part of the mold 9. The forming of the diaphragm 2 as well as the insertion of the coil 5 in the recess 4 therefore takes place in one process step. In the same process step the contacting of the connecting leads 6*a*, 6*b* with the conductive areas 3*a*, 3*b* then takes place. The associated contact points 8*a*, 8*b* then lie in the lower area of the recess 4. The contacting can then take place either simply by body contact or also by gluing, welding or soldering. The heat and the pressure, which are supplied for the deformation of the diaphragm 2, can then be used at the same time for a (cold-press) welding or solder joint. Both offer the advantage of the longer lifespan and the lower transition impedance vis-à-vis the mere body contact.

When soldering, a solder must reach the contact points 8*a*, 8*b*. This can take place in such a way that either the connecting leads 6*a*, 6*b* or the conductive areas 3*a*, 3*b* or both are provided with solder balls in the corresponding places before the molding process. When forming the recess 4 by the coil 5, at the same time also said solder joint is then produced in succession.

When welding, the supply of an additive can be dispensed with, as a result of which the contacting is simpler to produce in this way. As the temperatures for molding the diaphragm 2 would generally be below the melting temperature of the metals used with connecting leads 6*a*, 6*b* and conductive areas 3*a*, 3*b*, the parts are connected by what is called cold-press welding.

Finally, the contacting can also take place by means of an electrically conductive adhesive, which is applied on the connecting leads 6*a*, 6*b* or on the contact points 8*a*, 8*b* like the solder when soldering.

Figure 2E:
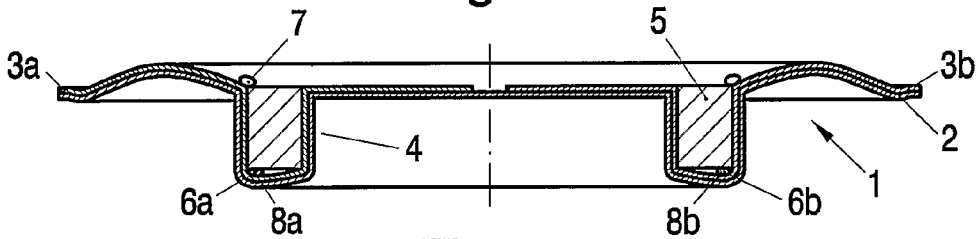

FIG. 2*e* finally shows the finished vibrating element 1. In fact the coil 5 is held in the recess 4 in principle by friction or form fit, but in the present case adhesive 7 is additionally applied to secure the coil against falling out. Naturally, it is also possible for the coil 5 to be coated with adhesive before the molding process and thus be adhered to the diaphragm 2 or the conductive areas 3*a*, 3*b* respectively in the area of the recess 4.

Figure 3A:
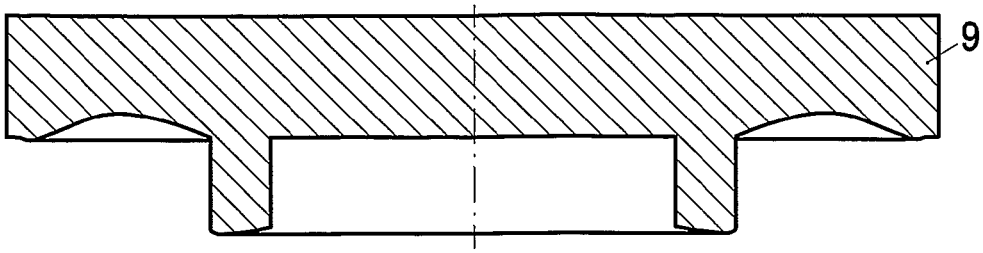
FIGS. 3*a*-3*e*: show the steps for the production of a vibrating element of FIGS. 1*a*, 1*b*, in accordance with a second production process.
Figure 3B:
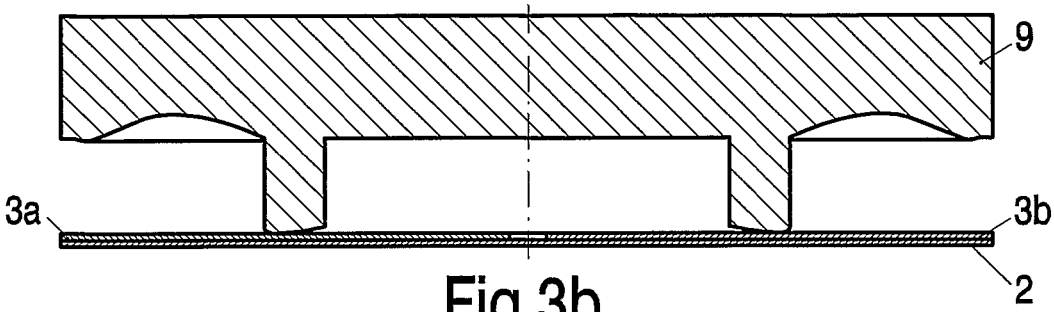
Figure 3C:
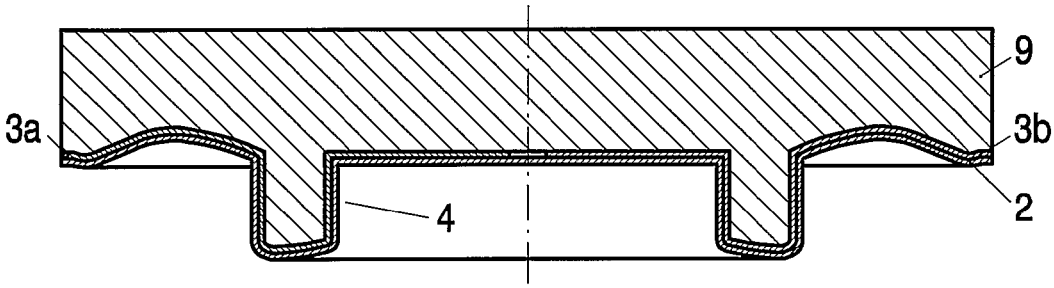

The FIGS. 3*a*-3*e* now illustrate the steps for the production of a vibrating element from FIGS. 1*a*, 1*b* in accordance with a second production process. FIG. 3*a* shows the empty mold 9. The shape of the coil 5 is integrated with the mold 9 itself in contrast to the first production process. Now in a first step 3*b* the diaphragm 2, which already comprises conductive areas 3*a*, 3*b* in the form of a metallic coating, is led to the mold 9. The diaphragm 2 is again heated beforehand, so that the molding process can take place more easily.

Figure 3D:
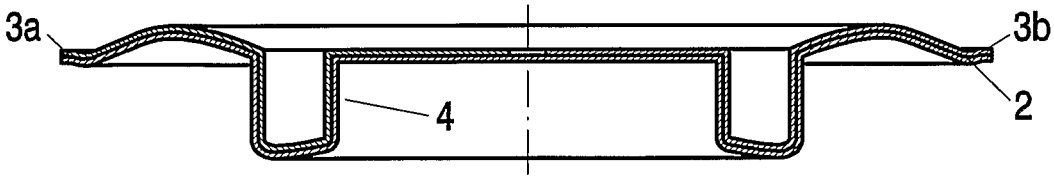

In a second step 3*c* the diaphragm 2 is formed. Increased air pressure is applied on the side of the diaphragm 2 turned away from the mold 9, so that the diaphragm 2 is pressed against the mold 9. In practice, necessary fixings and sealings are again not represented for the sake of simplicity. Here too there is the possibility of pressing a corresponding countermold against the diaphragm 2. The forming of the diaphragm 2 as well as the insertion of the coil 5 into the recess 4 does not take place here in one process step. The formed diaphragm 2, which is shown in FIG. 3*d*, therefore represents a semi-finished product. Only in a further process step 3*e* is the coil 5 inserted into the recess 4, and will also the contacting of the connecting leads 6*a*, 6*b* with the conductive areas 3*a*, 3*b* take place. The associated contact points 8*a*, 8*b* again lie in the lower area of the recess 4.

Figure 3E:
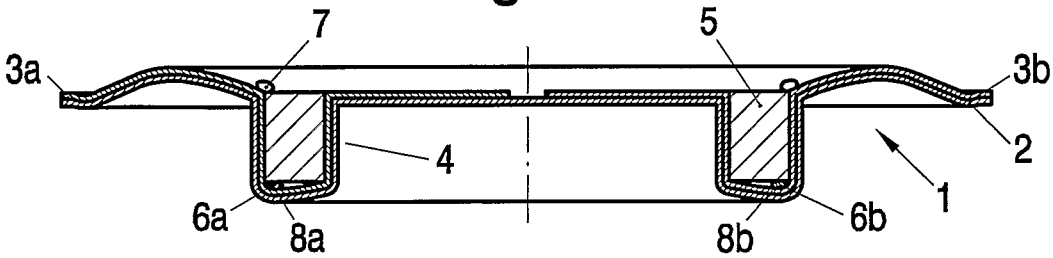

The contacting can take place by body contact, gluing, welding or soldering, just like the previous example. It is then to be noted, however, that depending upon connecting methods, heat and pressure must be supplied externally if necessary. Advantages may then occur, for example, when the contacting takes place by means of an electrically conductive adhesive, which is heat-sensitive. With this method the diaphragm 2 can be cooled down accordingly, before the coil 5 is inserted into the recess 4. FIG. 3*e* finally shows the finished vibrating element 1. Here too adhesive 7 is additionally applied to secure; the coil against falling out.

Figure 4:
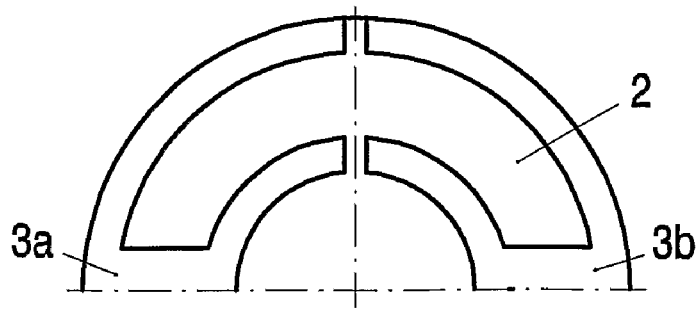
FIG. 4: shows an advantageous arrangement of the electrically conductive areas for a diaphragm coated on one side.

FIG. 4 now shows an advantageous arrangement of the electrically conductive areas 3*a*, 3*b* for a diaphragm 2 coated on one side. Both conductive areas 3*a*, 3*b* each cover almost 180° of an inner and an outer circular ring, which circular rings are connected to each other by a bridge. After the molding operation of the diaphragm 2 the inner circular ring is located in the area of the recess 4, so that the conductive areas 3*a*, 3*b* can be contacted with the connecting leads 6*a*, 6*b* of the coil 5. The coil 5 can therefore—if the connecting leads 6*a*, 6*b* are opposite each other—be turned by almost 180° degrees around its axis of rotation, without this impairing the contacting. This is advantageous in order to be able to compensate for tolerances when inserting the coil 5 into the recess 4.

Because of the outer rings, the same also applies to external connecting leads of an electroacoustic transducer, which comprises a vibrating element 1 in accordance with the invention. The vibrating element 1 can then—provided that the connecting leads are opposite each other—be turned likewise by almost 180° degrees around its axis of rotation, without this impairing the contacting of the external connecting leads, which are arranged at a specific position of the transducer with an electrically conductive area 3*a*, 3*b* each. This is again advantageous, for being able to compensate for tolerances when the vibrating element 1 is inserted into a housing of the electroacoustic transducer. FIG. 4 shows a material-saving form of the coating, naturally the conductive areas 3*a*, 3*b* can also be arranged approximately in a semicircle.

Figure 5:
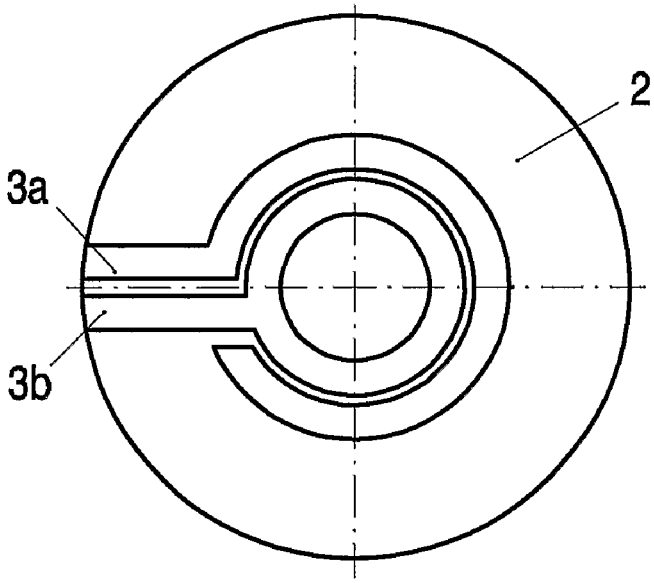
FIG. 5: shows a further advantageous arrangement of the electrically conductive areas for a diaphragm coated on one side.

FIG. 5 shows a further advantageous arrangement of the electrically conductive areas 3*a*, 3*b* for a diaphragm 2 coated on one side. The conductive areas 3*a*, 3*b* are then formed by two concentric circular rings, which are each connected with the external area of the diaphragm 2 by a bridge. The outer one of the two rings is then interrupted by the bridge of the inner ring. The rings are located in such a way on the diaphragm 2 that the conductive areas 3*a*, 3*b* are arranged in the lower and/or side area of the recess 4 respectively (also refer to FIGS. 7 and 8). Both conductive areas 3*a*, 3*b* now cover almost 360° of the inner and of an outer circular ring. Therefore, the coil 5 can—if the connecting leads 6*a*, 6*b* lie beside each other—be turned by almost 360° degrees each around its axis of rotation, without this impairing the contacting between conductive areas 3*a*, 3*b* with the connecting leads 6*a*, 6*b*. This is again advantageous for being able to compensate for tolerances when the coil 5 is inserted into the recess 4.

In the present case a vibrating element 2, which is inserted into a housing of an electroacoustic transducer, can only barely be rotated, as the conductive areas 3*a*, 3*b* are present only at a position of the outer region of the diaphragm 2. This problem can, however, be avoided by arrangement of corresponding rings also in said outer region. FIG. 5 again shows a material-saving form of the coating, naturally the conductive areas 3*a*, 3*b* can also cover approximately the whole diaphragm 2.

Figure 6:
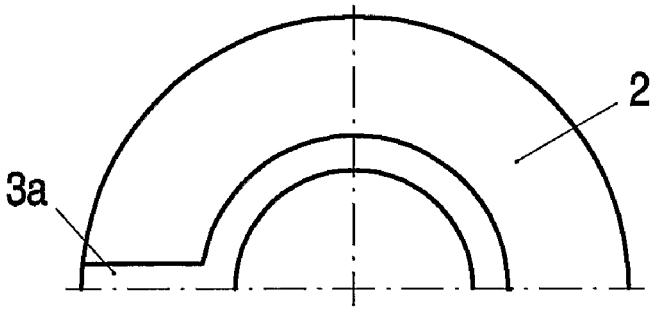
FIG. 6: shows an advantageous arrangement of the electrically conductive areas for a diaphragm coated on two sides.

FIG. 6 now shows an arrangement of the electrically conductive areas 3*a*, 3*b* for a diaphragm 2 coated on two sides. The conductive areas 3*a*, 3*b* are identical here, the first conductive area 3*a* being arranged on the upper side of the diaphragm 2, the second conductive area 3*b* being arranged on the underside of the diaphragm 2. The conductive areas 3*a*, 3*b* are formed by one circular ring each, which are connected with the external area of the diaphragm 2 by a respective bridge. The rings are arranged on the diaphragm 2 in such a way that the conductive areas 3*a*, 3*b* are arranged after the formation in the lower and/or side area of the recess 4 (also refer to FIG. 9). In this case both conductive areas 3*a*, 3*b* cover 360° of a circular ring. The coil 5 can then be inserted arbitrarily without this impairing the contacting between conductive areas 3*a*, 3*b* with the connecting leads 6*a*, 6*b*. With this variant one of the connecting leads 3*a*, 3*b* penetrates the diaphragm 2, so that the conductive area 3*b*, lying below can also be contacted.

In the present case a vibrating element 1, which is inserted into a housing of an electroacoustic transducer, can only barely be rotated, as the conductive areas 3*a*, 3*b* are again present only at a position of the outer region of the diaphragm 2. This problem can, however, also be avoided by arranging corresponding rings in said outer region. FIG. 6 shows another material-saving form of the coating; naturally the conductive areas 3*a*, 3*b* may also cover the whole diaphragm 2.

Figure 7:
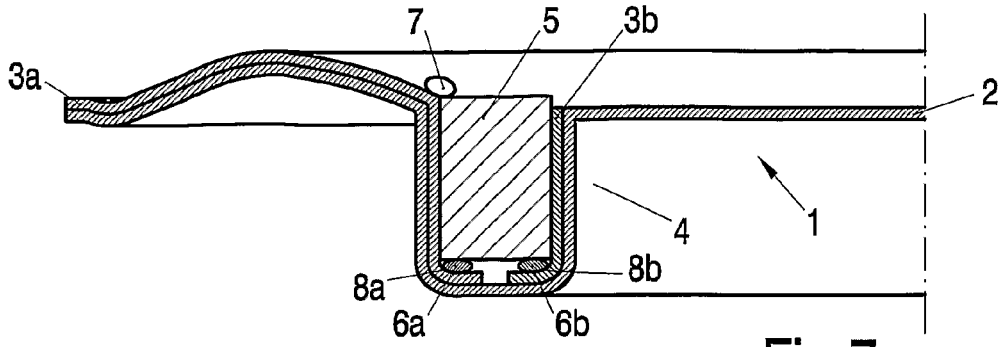
FIG. 7: shows a vibrating element in which both contact points are arranged at the bottom on the inside of the recess.

FIG. 7 shows a vibrating element 1 in section, with which both contact points 8*a*, 8*b* are arranged below on the inside of the recess 4. The FIG. 7 comprises a diaphragm 2 with two electrically conductive areas 3*a*, 3*b* separated from each other, as well as a recess 4. A first conductive area 3*a* then covers the inner area of the recess 4 farther from the center, a second conductive area 3*b* covers the inner area of the recess 4 closer to the center. In the recess 4 again a coil 5 is arranged with two connecting leads 6*a*, 6*b*. Then, a first connecting lead 6*a* lies farther from the center and is therefore contacted at a first contact point 8*a* with the first conductive area 3*a*. Similarly, the second connecting lead 6*b* lies closer to the center and is therefore contacted with the second conductive area 3*b* at a second contact point 8*b*. The coil 5 is again secured against falling out by means of adhesive 7.

It is noted that the connecting leads 6*a*, 6*b* do not mandatorily protrude only at a place above the underside of the coil 5, but can form two circular rings protruding above the coil 5. In this way, the coil 5 can then also be inserted into the recess 4 in a twisted way, if the conductive areas 3*a*, 3*b* are provided only at one position of the diaphragm 2.

Figure 8:
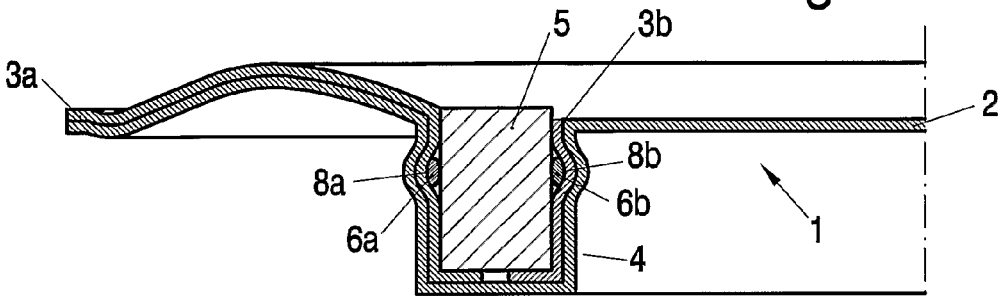
FIG. 8: shows a vibrating element in which both contact points are arranged on the sides on the inside of the recess.

FIG. 8 shows a vibrating element 1 similar to FIG. 7, with which contact points 8*a*, 8*b* are, however, not arranged on the underside of the recess 4, but on the side faces. Advantageously, the molding process takes place here by means of compressed air, as in this case the undercuts resulting from the contact points 8*a*, 8*b* do not play a role here. As the form fit between coil 5 and recess 4 is sufficient with contact points 8*a*, 8*b* being present on the sides, an additional gluing of the coil 5 is avoided. It is then conceivable for the connecting leads 6*a*, 6*b* to enclose the entire extent of the coil 5, in order to yet increase said form fit. It should be noted at this point that also other forms of undercuts may be used to provide or increase the form fit between coil 5 and recess 4. For example the coil 5 may have indentations or bulges provided by a special arrangement of the wire windings.

Figure 9:
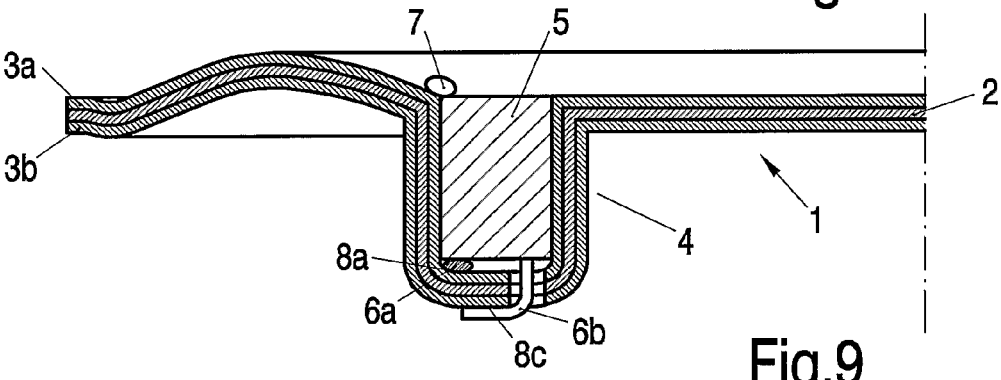
FIG. 9: shows a vibrating element in which one contact point is arranged on the inside and one on the outside of the recess.

FIG. 9 now shows a vibrating element 1, with which a first contact point 8*a* is arranged on the inside and a second contact point 8*c* is arranged on the outside of the recess 4. The diaphragm 2 is coated on two sides in this case, so that the first conductive area 3*a* is arranged on the upper side of the diaphragm 2, the second conductive area 3*b* is arranged on the underside of the diaphragm 2. The first connecting lead 6*a* of the coil 5 is contacted as in the example in accordance with FIG. 7, however, the second connecting lead 6*b* is led through a hole in the diaphragm 2 and the conductive areas 3*a*, 3*b*, is bent on the outside of the recess 4 and is contacted there with the second conductive area 3*b* at the contact point 8*c*. In this case the diaphragm 2 can be coated all over, which under circumstances is an advantage in the production. This arrangement can be of advantage with the contacting of external connecting leads of an electroacoustic transducer also, if, for example, the structural conditions render such a connection necessary.

Figure 10:
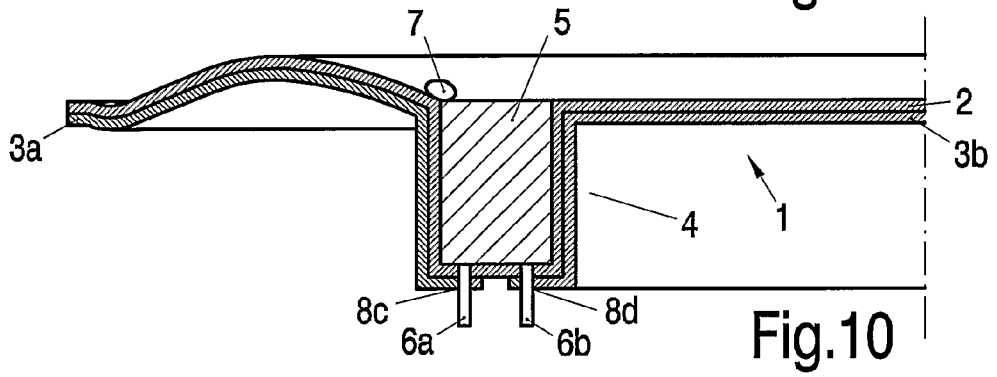
FIG. 10: shows a vibrating element in which both contact points are arranged on the outside of the recess.

FIG. 10 finally shows a vibrating element 1 with which both contact points 8*a*, 8*b* are arranged on the outside of the recess 4. The diaphragm 2 is in this case coated only on the underside. The electrically conductive areas 3*a*, 3*b* can then be formed, for example, as in FIG. 4 or 5. When inserting the coil 5 into the recess 4, the connecting leads 6*a*, 6*b* penetrate the diaphragm 2 and the conductive areas 3*a*, 3*b* and are contacted with the latter at the contact points 8*c*, 8*d*. Since the contact points 8*c*, 8*d* come to lie on the outside of the recess 4, these can also be easily soldered or glued together. A welding is also possible, particularly if the connecting leads 6*a*, 6*b* are bent. Contrary to FIG. 9, here the diaphragm 2 has no hole yet when the coil 5 is inserted into the recess 4, but is not pierced until this step. The warming up of the diaphragm 2 supports this operation. It is also possible that the connecting leads 6*a*, 6*b* are heated, if necessary, even above the melting temperature of the diaphragm 2.

For the sake of completeness it is noted that the invention naturally also refers to other diaphragms than circular diaphragms 2 (for example, rectangular, oval, etcetera), even if always circular diaphragms 2 are represented in the Figures.

Further it is pointed out that the electrically conductive areas 3*a*, 3*b* need not mandatorily be produced by a metallic coating. Rather, coatings of, for example, conductive plastic or the like are also possible. It is also possible that no such coating is present, but the diaphragm in the conductive areas 3*a*, 3*b* is doped and even becomes electrically conductive there.

It is also pointed out that as a rule for perfect contact the insulation of the connecting leads 6*a*, 6*b* has to be stripped off beforehand at the intended places. It could also be possible that an insulation is destroyed by the temperature prevailing at the contact point 8*a*, 8*d* during contact and therefore need not be removed in a separate step.

Incidentally, an increased temperature is not absolutely necessary for the deformation of the diaphragm 2. Rather, it is possible for the diaphragm 2 to be deformed, for example, at room temperature.

Finally, the use of a low-melting solder is possible for said solder joints. The temperature found during the deforming process of the diaphragm 2 may even not be sufficient to heat a standard solder to melting point. In this context U.S. Pat. No. 6,740,544 already mentioned, is referred to.

Finally, it is also mentioned, that the characteristics in accordance with the invention can appear both individually and in combination, even if they were only stated in combination or individually. The term "comprise" does not exclude the existence of additional characteristics in the method in accordance with the invention, or in the objects in accordance with the invention. Furthermore, a reference to a single step or a single element does not exclude the presence of a plurality of these steps or elements and vice versa.

The invention claimed is:

1. A vibrating element for an electroacoustic transducer comprising:

a diaphragm with a recess and at least two electrically conductive areas, which are separated from each other, and a coil arranged in the recess and having a top side, a bottom side, an outer side, an inner side, and two connecting portions in respective electrical communication with the two electrically conductive areas, wherein each of the connecting portions is located at one of the outer side, the inner side, and the bottom side of the coil.

2. A vibrating element as claimed in claim 1, in which both contact points are arranged on the inside of the recess or in which both connecting leads penetrate the diaphragm in the lower area of the recess and both contact points are on the outside of the recess or in which a contact point is arranged on the inside of the recess and a connecting lead penetrates the diaphragm in the lower area of the recess and the associated contact point is on the outside of the recess.

3. A vibrating element as claimed in claim 1, in which the conductive areas are formed such that the connecting leads are electrically contacted with the conductive areas largely independently of the mounting position of the coil.

4. An electroacoustic transducer, which comprises a vibrating element as claimed in claim 1.

5. An electroacoustic transducer as claimed in claim 4, in which the conductive areas of the diaphragm are formed in such a way that two external connecting leads, which are arranged at a specific position of the transducer, contact one electrically conductive area each, to a large extent independently of the mounting position of the vibrating element.

6. A vibrating element as in claim 1, wherein the connecting portions are located at a same said side of said coil.

7. A method for producing a vibrating element for an electroacoustic transducer, in which a diaphragm of the vibrating element first has at least two electrically conductive areas, separated from each other, which method comprises the steps of:

producing a recess in the diaphragm, and inserting a coil, which comprises a top side, a bottom side, an outer side, an inner side, and two connecting portions in respective electrical communication with the two electrically conductive areas, wherein each of the connecting portions is located at one of the outer side, the inner side, and the bottom side of the coil.

8. A method as claimed in claim 7, in which both contact points are located on the inside of the recess or in which both connecting leads penetrate the diaphragm in the lower area of the recess and both contact points are located on the outside of the recess or in which a contact point is located on the inside of the recess and a connecting lead penetrates the diaphragm in the lower area of the recess and the associated contact point is located on the outside of the recess.

9. A method as claimed in claim 7, in which the coil is taken up in a mold for the manufacture of the diaphragm and constitutes a part of the mold, with which mold the recess is produced, and the providing of the recess as well as the inserting of the coil into the recess takes place in one process step.

10. A method as claimed in claim 9, in which also the contacting between conductive areas and connecting leads takes place in the same process step.

11. A method as claimed in claim 10, in which pressure or heat, or a combination thereof, are supplied during the making of the recess, whereby both the deformation process and the contacting process are supported or enabled at the same time.

12. A method as claimed in claim 7, characterized in that the diaphragm is made electrically conductive in such an area that despite predefined tolerances the connecting leads are contacted reliably with the conductive areas when the coil is inserted into the recess.

13. A method as in claim 7, wherein the connecting portions are located at a same said side of said coil.

* * * * *